US008725048B2

(12) United States Patent
Robles-Flores et al.

(10) Patent No.: US 8,725,048 B2
(45) Date of Patent: May 13, 2014

(54) APPARATUS, METHOD AND SYSTEM FOR CONTROLLING A STRIP RADIUS IN A PRINTING SYSTEM

(75) Inventors: Eliud Robles-Flores, Webster, NY (US); Charles H. Tabb, Penfield, NY (US); John R. Falvo, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 162 days.

(21) Appl. No.: 13/524,130

(22) Filed: Jun. 15, 2012

(65) Prior Publication Data

US 2013/0336685 A1 Dec. 19, 2013

(51) Int. Cl.
*G03G 15/20* (2006.01)

(52) U.S. Cl.
USPC ..... 399/323; 399/329

(58) Field of Classification Search
CPC ..... G03G 15/20
USPC ..... 399/329, 323
See application file for complete search history.

(56) References Cited

U.S. PATENT DOCUMENTS

| | | | | |
|---|---|---|---|---|
| 8,073,372 | B2 | 12/2011 | McNamee et al. | |
| 8,478,148 | B2 * | 7/2013 | Nakatsuhara et al. | 399/323 |
| 2010/0178085 | A1 | 7/2010 | Keenan et al. | |

* cited by examiner

*Primary Examiner* — Susan Lee
(74) *Attorney, Agent, or Firm* — Ronald E. Prass, Jr.; Prass LLP

(57) ABSTRACT

An apparatus, system and method are provided for causing one or more selectable strip radii associated with stripping a substrate from a belt in a fuser after an image has been fused to the substrate during a printing process. The fuser has a first member having a first surface, and a belt having a first portion that contacts the first surface of the first member. The fuser has a second member having a second surface that contacts a second portion of the belt in a region defining a fusing nip. The fuser has a stripping apparatus, positioned downstream of the fusing nip in a process direction, comprising one or more transducers that cause one or more respective transducer segments to move at a frequency that deflects one or more sections of the first portion of the belt to cause one or more selectable strip radii on demand.

25 Claims, 9 Drawing Sheets

APPARATUS, METHOD AND SYSTEM FOR CONTROLLING A STRIP RADIUS IN A PRINTING SYSTEM

FIELD OF DISCLOSURE

The disclosure relates to belt-roll fuser apparatuses, methods and systems useful in printing. Specifically, the disclosure relates to a belt-roll fuser that controls one or more selectable strip radii by way of a transducer-type stripping mechanism on demand.

BACKGROUND

Conventional belt-roll fusers include an internal pressure roll ("IPR"), that entrains a fuser belt, and an external pressure roll ("EPR"). A fusing nip is conventionally defined by a region under pressure between the EPR and the IPR. Conventional belt-roll fusers utilize a hard IPR and a soft EPR to form a fusing nip for fusing an image to a substrate that has just received toner from a transfer station. See FIG. 1 for an example of a related art belt-roll fuser architecture.

Conventional belt-roll fusers often have a stripping shoe that is used to load an inner side of the fuser belt to generate an effective fusing nip pressure, and cause the substrate to strip from the fuser belt at a position downstream of the fusing nip in a process direction. The presence of the stripping shoe causes a stripping radius at the position downstream of the fusing nip. The stripping radius is a function of the distance between the stripping shoe and one or more of the IPR and EPR, or, in other words, the roll-to-shoe gap. While the stripping shoe may help generate an effective fusing nip pressure, and cause the substrate to strip from the fuser belt, belt-roll fusers that utilize a conventional stripping shoe still often face image related defects such as, but not limited to, gloss related image quality ("IQ") defects, stripping performance, and failure to demonstrate process latitude. These issues may be caused by any number of issues, including, but not limited to, a variance in pressure in the fusing nip that results because of the stripping shoe, and/or failure to optimally strip the substrate from the fuser belt at an optimum moment during a printing process regardless of media size, media type, media weight, media thickness, media stiffness, fuser belt size, process speed, process conditions, image preferences etc.

SUMMARY

Apparatuses, methods and systems for use in printing are disclosed. Various exemplary embodiments improve image quality performance of belt-roll fusers by causing one or more selectable strip radii by way of a transducer-type stripping mechanism on demand.

According to one embodiment, a fusing apparatus useful in printing comprises a first member having a first surface. The apparatus further comprises a belt having a first portion that contacts the first surface of the first member. The apparatus also comprises a second member having a second surface that contacts a second portion of the belt in a region defining a fusing nip. The apparatus additionally comprises a stripping apparatus, positioned downstream of the fusing nip in a process direction, comprising one or more transducers configured to cause one or more respective transducer segments to move at a frequency so as to deflect one or more selected sections of the first portion of the belt to cause one or more selectable strip radii on demand at a stripping location associated with stripping a substrate from the belt downstream of the fusing nip in the process direction.

In one or more embodiments, the transducer may cause the belt to vibrate at a frequency that corresponds with the frequency at which the one or more respective transducer segments move to aid is stripping the substrate from the belt.

According to another embodiment, a method for stripping a substrate from a belt comprises defining a fusing nip in an apparatus useful in printing. The apparatus comprises a first member having a first surface. The apparatus further comprises a belt having a first portion that contacts the first surface of the first member. The apparatus also comprises a second member having a second surface that contacts a second portion of the belt at the fusing nip. The apparatus additionally comprises a stripping apparatus, positioned downstream of the fusing nip in a process direction, comprising one or more transducers configured to cause one or more transducer segments to move at a frequency so as to deflect one or more selected sections of the first portion of the belt to cause one or more selectable strip radii at a stripping location associated with stripping the substrate from the belt downstream of the fusing nip in the process direction. The method further comprises causing, at least in part, the one or more selectable strip radii on demand. The method also comprises causing, at least in part, stripping of the substrate from the belt.

According to another embodiment, a system useful in printing configured to strip a substrate from a belt at a position downstream of a fusing nip in a process direction comprises a first member having a first surface. The system also comprises a belt having a first portion that contacts the first surface of the first member. The system further comprises a second member having a second surface that contacts a second portion of the belt at the fusing nip. The system additionally comprises a stripping apparatus, positioned downstream of the fusing nip in the process direction, comprising one or more transducers configured to cause one or more transducer segments to move at a frequency so as to deflect one or more selected sections of the first portion of the belt to cause one or more selectable strip radii on demand at a stripping location associated with stripping the substrate from the belt downstream of the fusing nip in the process direction. The system, accordingly, strips the substrate from the belt at the stripping location downstream of the fusing nip in the process direction.

Exemplary embodiments are described herein. It is envisioned, however, that any system that incorporates features of any apparatus, method and/or system described herein are encompassed by the scope and spirit of the exemplary embodiments.

DETAILED DESCRIPTION

Figure 1:
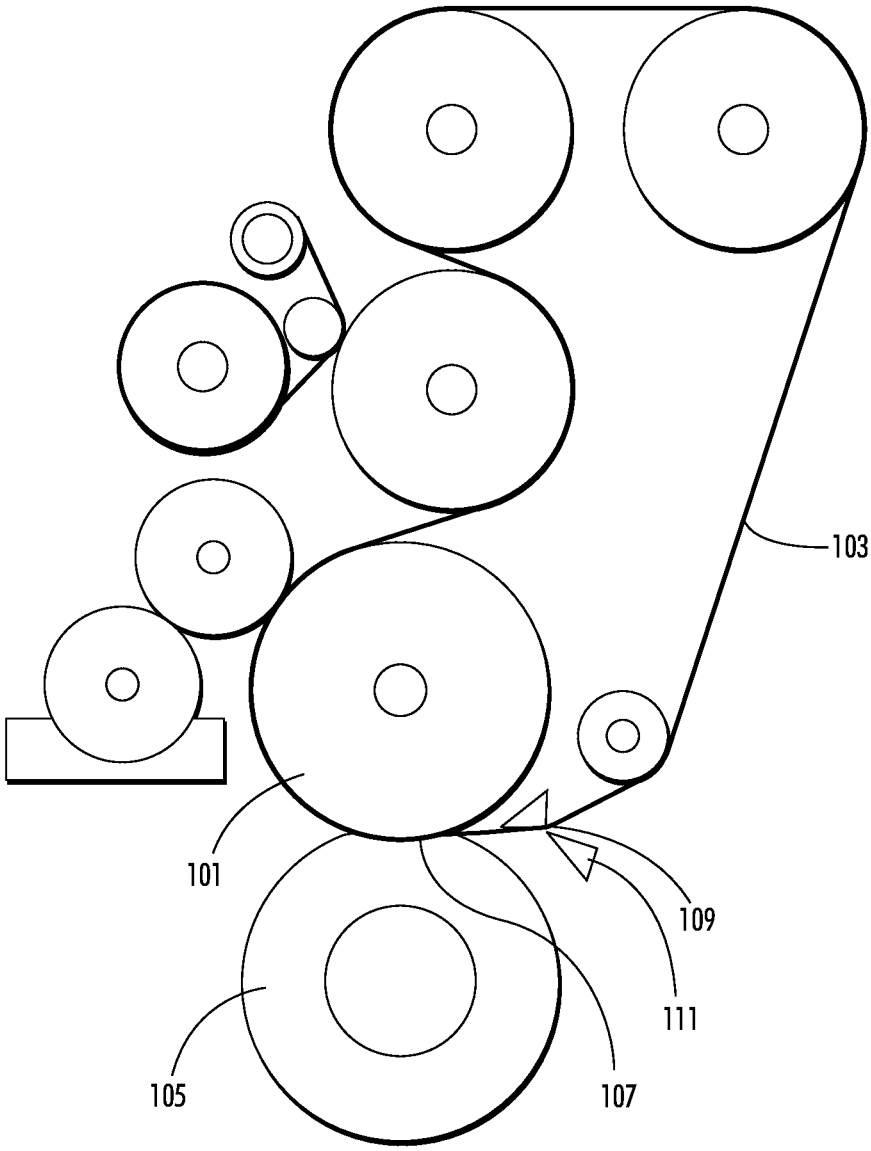
FIG. 1 RELATED ART
FIG. 1 is a diagrammatical side view of a related art belt-roll fuser.

Exemplary embodiments are intended to cover all alternatives, modifications and equivalents as may be included within the spirit and scope of the apparatuses, methods and systems as described herein.

Reference is made to the drawings to accommodate understanding of disclosed apparatuses, methods and systems useful in printing. In the drawings, like reference numerals are used throughout to designate similar or identical elements. The drawings depict various embodiments related to embodiments of illustrative apparatuses, methods and systems for causing one or more selectable strip radii by way of a transducer-type stripping mechanism to cause effective stripping of a substrate from a fuser belt during a printing process.

Apparatuses and systems of embodiments may include systems for printing images on media by fusing marking material to a substrate using a belt-roll fuser.

As used herein, the term "strip radius" or any variants thereof refers to a curvature of a fuser belt at a stripping location at which one or more media substrates upon which an image is printed and/or fused is stripped or removed from the fuser belt after the image is printed and/or fused to the media substrate in a fusing nip, for example.

As used herein, the term "media geometry" refers to a media size and/or thickness.

As used herein, the term "belt geometry" refers to a belt size and/or thickness.

As used herein, the term "image type" refers to a definition of a type of image such as, but not limited to, photo, text, color image, black and white image, artist rendering, computer rendering, gloss coating, ink type, etc.

As used herein, the term "image location" refers to the position of a print image on a media substrate. The image location may be defined by determining whether the image is centered on the substrate, determining margin dimensions around the image, determining gutters around an image or multiple images, etc.

As used herein, the term "process speed" refers to a speed at which a printing system prints images and/or feeds media through the system. For example, a process speed may refer to sheets per minute, RPM's of a fuser belt, RPM's of one or more rollers that are part of the print system, belt speed in mm/sec, etc.

As used herein, the term "process timing" refers to a moment in time at which a task is performed during a printing process associated with a position on the media substrate such as a lead edge, trailing edge, center portion, image starting portion in a process direction, image ending portion in a process direction, etc. Such tasks may include, but not be limited to, for example, stripping the media from a fuser belt, initiating a change in strip radius at a moment associated with a specific portion of the media as that specific portion of the media passes a point in the printer system associated with a designated task (e.g., stripping, printing, blowing air, exerting pressure, changing pressure, fusing, expelling ink or toner, causing a strip radius to change, etc.) during a printing process.

As used herein, the term "media" refers to any substrate upon which an image may be printed and/or fused during a print process. The term media may be used interchangeably with any of media, media substrate and/or substrate, and the like.

FIG. 1 illustrates a diagrammatical side view of an example related art belt-roll fuser 100. Conventional belt-roll fusers utilize a hard IPR 101, which entrains a fuser belt 103, and a soft EPR 105. The IPR 101, fuser belt 103 and EPR 105 form a fusing nip 107 for fusing an image to a substrate that has just received toner from a transfer station. Alternatively, belt-roll fuser 100 may utilize any combination of pressure members such as any combination of pressure belts and/or arrangement of hard and soft rolls. For simplicity, following discussion will be related to a dual-roll fuser. But regardless of the fuser type, the same or similar issues discussed below may occur.

The substrate may be any form of media upon which marking material, such as toner, may be deposited. The substrate may be fed by the belt-roll fuser 100 through the fusing nip 107 in a process direction from a nip entrance to a nip exit. The belt-roll fuser 100 may then be configured to apply, e.g., pressure and heat at the fusing nip 107 to fuse a marking material to the substrate.

The fuser belt 103 may be entrained by one or more components of the belt-roll fuser 100. For example, the fuser belt 103 may have a first side and a second side. The first side, for example, may be an inner side that contacts the IPR 101, and may also contact other members of the belt-roll fuser 100 that may entrain the fuser belt 103. The second side may contact the EPR 105, and/or a substrate that passes through the fusing nip 107.

Belt-roll fusers that utilize conventional IPR and EPR architecture such as that illustrated in FIG. 1 often face image related defects such as, but not limited to, gloss related IQ defects, stripping performance, and failure to demonstrate process latitude. These issues may be due to variability in fusing nip geometry caused by factors such as IPR and/or EPR elastomer bulge, temperature variation, shoe location, and inboard to outboard nip dynamics, as well as a fixed strip shoe 109 geometry across the fuser belt 103 at a stripping location positioned downstream of the fusing nip in a process direction.

To help with the aforementioned image related defects, the related art belt-roll fuser 100 illustrated in FIG. 1 uses a strip shoe 109 to load the fuser belt 103 and aid in stripping a substrate from the fuser belt 103. The belt-roll fuser 100 also uses an air knife 111 to aid in stripping the substrate from the fuser belt 103. Paper tends to stick to the fuser belt 103 after passing through the fusing nip 107. The strip shoe 109 provides a small (<5 mm) stripping radius such that the paper will peel away from the fuser belt 103.

While some strip shoes 109 may be caused to selectively vary the stripping radius by changing its position relative to one or more of the IPR 101 and EPR 105, for example, conventional strip shoes 109 are fixed in width across the fuser belt 103, and are not quickly adaptable on demand to change the stripping radius in one or more locations across the width of a substrate as needed. This results in inconsistent stripping performance which may cause the above-mentioned image-related defects, as well as increased wear on the components of the belt-roll fuser 100 such as the fuser belt 103. For example, because the strip shoe 109 is fixed in width across the fuser belt 103, there is not enough process latitude to accommodate different sized media, different types of media, media of different stiffness, printing/process speeds, different process conditions, image types or locations, different belt sizes, etc. that may require or benefit from selectively variable or different strip radii at any moment on demand across the width of the fuser belt 103.

It is difficult for belt-roll fusers to simultaneously optimize both fusing and stripping functions for all media weights in apparatuses that include at least one pressure roll (IPR 101 and EPR 105), and a fuser belt 103. For example, when such fusers are operated using the same process parameters for all media weights, instead of using the optimal conditions for each different media type, light-weight media can be over-fused, heavy-weight media can generate excessive edge-wear in the fuser belt 103, and image defects may occur because of inefficient stripping. Further, having a strip shoe 109 that is of a fixed geometry across the width of the fuser belt 103 may generate excessive wear of the fuser belt 103 if, for example, the entire strip shoe 109 is not needed for a smaller media size. In other words, the strip shoe 109 may contact a portion of the fuser belt 103 unnecessarily to create a stripping radius in an unneeded area of the fuser belt 103.

Accordingly, there is a need for a fuser system that provides reliable stripping performance by creating one or more selectable stripping radii across the width of the fuser belt 103 on demand to accommodate different media types, media weights, media sizes, process conditions, image preferences, image types, image locations, belt sizes, etc., to improve quality and increase process latitude.

Figure 2:
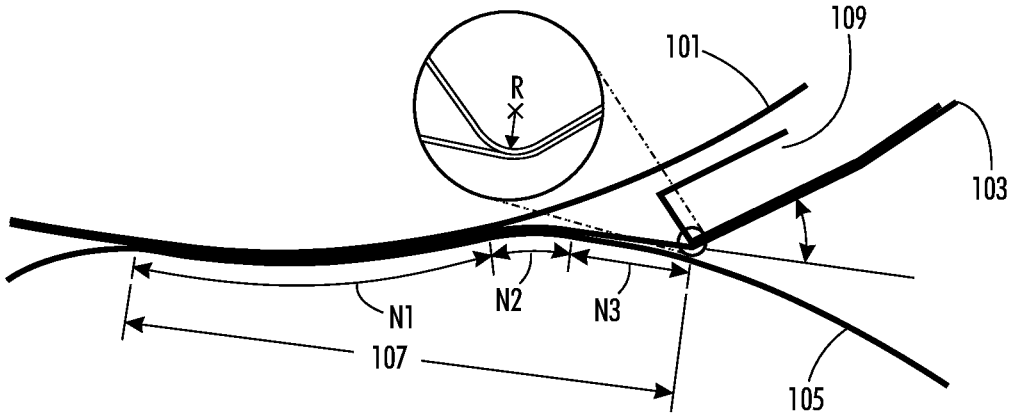
FIG. 2 RELATED ART
FIG. 2 is a diagrammatical side view of a fusing nip of a related art belt-roll fuser.

FIG. 2 illustrates a diagrammatical side view of the geometry of the fusing nip 107, as discussed above. The fusing nip 107 is divided into three zones caused by conventional dual-roll architecture and the presence of the strip shoe 109. First, a primary, high-pressure, fusing nip (N1) is defined by a region generated by the interference of the IPR 101 and the EPR 105. Second, a low pressure contact nip (N2) is defined by a region in which the fuser belt 103 is in contact with the EPR 105 and not in contact with the IPR 101. Third, a free span (N3) is defined by a region between N2 and the strip shoe 109 where the fuser belt 103 is not in contact with either the IPR 101 or the EPR 105.

This three-nip geometry results in varying nip pressure throughout the fusing nip 107 and causes inconsistent stripping performance, which in turn causes the above-mentioned image-related defects. For example, the unsupported free span N3 may be one of the causes of image gloss defects. As the lead edge of a substrate travels through N2 , substrates such as heavyweight sheets, for example, often do not conform to the shape of the EPR 105 with only belt tension producing a downward force (pressure in N2 may be less than 10 psi, for example). The downward force is only produced by belt tension in N2 in this example because the fuser belt 103 is no longer in contact with the IPR 101. Accordingly, because of the beam strength of the substrate, it may separate from the fuser belt 103, then retouch later as the beam length of the substrate increases. This separation and retouching causes a gloss defect called "icicles."

Additionally, for example, depending on the density and location of an image, a substrate can stick to the fuser belt 103 or to the EPR 105 as it travels through the free span N3. The substrate may separate from and retouch the fuser belt 103 in the free span N3 causing image quality defects known as "retack."

It is difficult to orient the strip shoe 109 to eliminate the N2 and N3 regions. The N2 and N3 regions, as discussed above are caused by variances in pressure in the fusing nip 107. While the strip shoe 109 may be positioned to optimize stripping performance by causing a strip radius on the fuser belt 103 based on the shoe-to-roll gap at a stripping location downstream of the fusing nip 107, and minimize the image defects, its positioning is difficult to perfect because of thermal expansion that may occur in the IPR 101, the EPR 105 and/or the fuser belt 103, as well as uncontrolled bulges that may occur in the IPR 101 and/or the EPR 105 beyond the fusing nip 107. It is further difficult to perfectly place the strip shoe 109 because of various wearing that may occur on any of the IPR 101, EPR 105, fuser belt 103 and strip shoe 109, as well as changes in durometer of the IPR 101 and/or the EPR 105. Additionally, conventional strip shoes 109 are difficult to effectively change the strip radius on demand because they are typically fixed or are not capable of quick positional adjustments on demand to account for the aforementioned factors.

Despite the variance in pressure that occurs between N1 and N2, certain substrates perform well in a long N2 region. Making the N2 region too short can cause stripping issues that result in the some of the image quality issues discussed above, as well as others. Accordingly, there is a need for a fuser system that provides reliable stripping performance by way of, for example, adjusting the strip radius of the fuser belt 103 on demand to account for the above discussed variances in fusing nip geometry, and any process conditions that may affect image quality and stripping performance.

Figure 3:
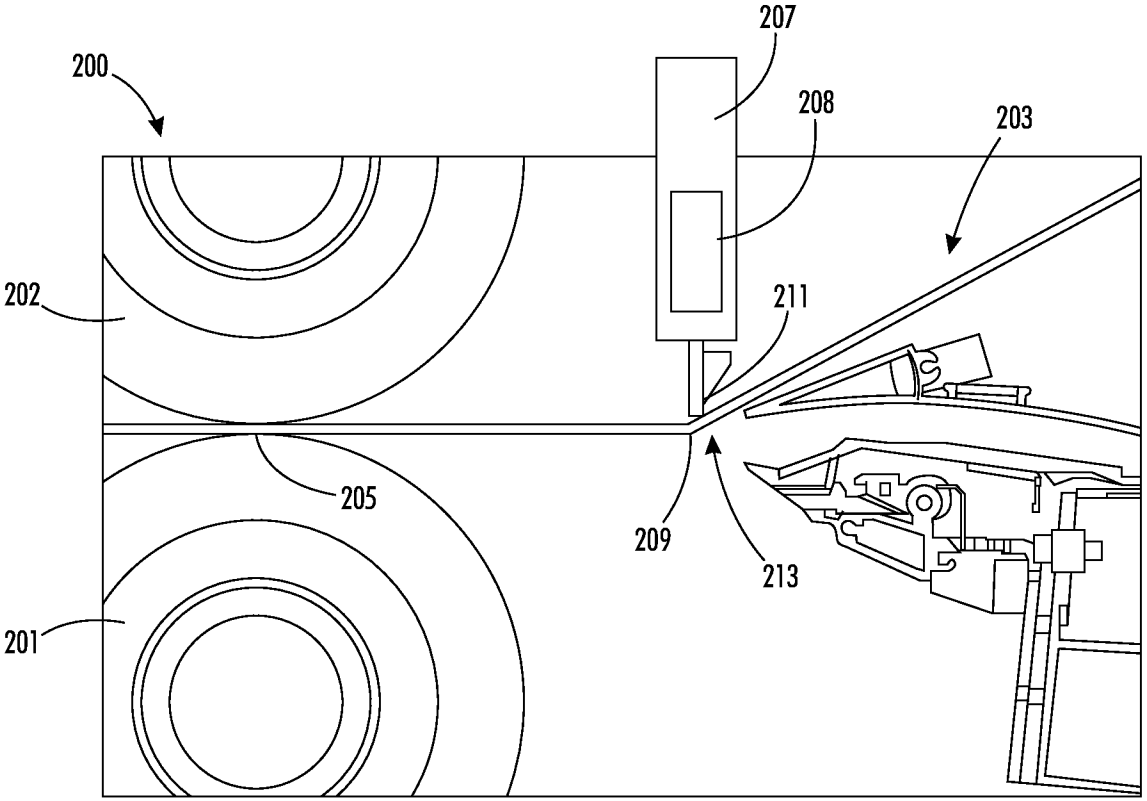
FIG. 3 is a diagrammatical side view of a belt-roll fuser having a transducer-type stripping mechanism, according to one example embodiment.

FIG. 3 illustrates a diagrammatical side view of a belt-roll fuser 200 that causes one or more selectable strip radii on demand by way of a transducer-type striping mechanism to affect image quality and stripping performance, according to one embodiment.

The belt-roll fuser 200 includes one or more pressure members such as EPR 201 and IPR 202 that form a fusing nip 205. EPR 201 and IPR 202 have a fuser belt 203 entrained between them at the fusing nip 205. EPR 201 and/or IPR 202, in this example, may be a drum or roll that is rotatable about its longitudinal axis. Alternatively, the EPR 201 may be replaced by a pressure belt to form the fusing nip 205. The EPR 201 and/or IPR 202 may comprise any elastomer material, rubber, polymer and/or metal. The IPR 202 may similarly be replaced by a pressure belt and/or series of rolls and/or support elements that entrain the fuser belt 203. In other words, the belt-roll fuser 200 may be any style such as a dual-roll fuser discussed above with respect to FIG. 1, or a dual-belt fuser, for example. Any other member of the belt-roll fuser 200 that entrains the fuser belt 203 may comprise elastomer material, rubber, polymer, and/or metal, for example. For simplicity, the remainder of this discussion will refer, however, to a fuser having at least the EPR 201 and the IPR 202.

The EPR 201, the IPR 202, and the fuser belt 203 define the fusing nip 205 in a region at which both of (1) the EPR 201 and the fuser belt 203 are in contact with one another, and (2) the IPR 202 and the fuser belt 203 are in contact with one another.

According to one example embodiment, the belt-roll fuser 200 may include one or more stripping mechanisms 207 (hereinafter collectively referred to as "stripping mechanism 207") that may be used to cause one or more selectable strip radii 209 on demand downstream of the fusing nip 205 in a process direction. The stripping mechanism 207 may also be configured to cause one or more selectable strip radii 209 across the width of the fuser belt 203 to accommodate different sized media or image preferences, such as image location, for example.

In one or more embodiments, the stripping mechanism 207 may comprise one or more transducers such as ultrasonic transducers 208 having one or more selectively actuated transducer segments 211 that may be actuated so as to move or pulse at a controllable frequency and amplitude. Though described primarily as being an ultrasonic transducer, the one or more transducers may be any type, and may or may not cause the one or more transducer segments 211 to move at an ultrasonic frequency. For example, the one or more transducers may simply move at any selected frequency which may or may not be an ultrasonic frequency.

When actuated, the one or more transducer segments 211 press against an inside of the fuser belt 203 at the controlled frequency and amplitude so as to deflect the fuser belt 203 a predetermined amount. The deflection of the fuser belt 203 causes, at least in part, the one or more selectable strip radii 209 at a stripping location 213. The stripping location 213 may be a precise position on the fuser belt 203 at which a substrate is optimally stripped to avoid the aforementioned IQ defects, or a range within which the substrate should be stripped from the fuser belt 203 to avoid the aforementioned IQ defects.

In one or more embodiments, as discussed above, the transducer segments 211 may be individually caused to move or pulsate from an "up" position away from the fuser belt 203, to at least one "down" position that deflects the fuser belt 203 a predetermined amount by the transducer 208 that causes the transducer segments 211 to move at an ultrasonic frequency so that the deflection of the fuser belt 203 that causes the one or more selectable strip radii 209 appears to be constant. The movement of the one or more transducer segments 211, in one or more embodiments, may be based, at least in part, on a controllable frequency of movement of the one or more transducer segments 211. The degree of movement, as discussed above, may be based on a controllable amplitude of movement of the transducer segments 211.

In one or more embodiments, the amplitude and/or frequency may be varied based on process conditions to cause, at least in part, a substrate having an image fused to it in the fusing nip 205 to be stripped from the fuser belt 203 at an opportune moment. The opportune moment may be, for example, a moment at which the substrate passes the stripping location 213 during the printing process. The strip radii 209 may be adjusted to enable stripping the substrate at the stripping location 213 based, at least in part, on a media thickness, media material, image location, process timing, process condition, etc. which may be adjusted on the fly to account for the aforementioned factors, or adjust for any detected print defects that result from insufficient stripping, for example.

In one or more embodiments, the ultrasonic movement of the one or more transducer segments 211 may be controlled such that the movement may be stepped or linear. For example, the movement may be stepped or ramped up or down to meet the desired ultrasonic frequency based on particular printing preferences on demand.

The movement of the transducer segments 211 caused by the stripping mechanism 207 not only deflects the fuser belt a predetermined amount based on the predetermined amplitude to cause the one or more selectable strip radii 209, but also causes the fuser belt 203 to vibrate at the frequency at which the transducer segments 211 move. This vibration of the fuser belt 203 may aid in stripping the substrate from the fuser belt 203 at the stripping location 213, for example. Additionally, the frequency of movement of the one or more transducer segments 211 may be adjusted to modify the amount of vibration the fuser belt 203 experiences to affect stripping performance on demand.

In one embodiment, there may be a singular transducer segment 211. In alternative embodiments, there may be two or more transducer segments 211 positioned across the width of the fuser belt 203. The two or more transducer segments 211 may be selectively actuated on demand to cause the same or different magnitude strip radii 209 across the width of the fuser belt 203. The selective actuation of the two or more transducer segments 211 may enable the belt-roll fuser 200 to accommodate different sized substrates by not actuating unnecessary transducer segments 211 at positions across the fuser belt 203 where a strip radius is unnecessary.

For example, the belt-roll fuser 200 may determine a media size. Upon determining the media size, the belt-roll fuser 200 may cause the stripping mechanism 207 to only actuate transducer segments 211 that may correspond, and be applicable to optimally stripping, the determined media size. For example, if a fuser belt 203 has a width that is greater than the determined media size, it may be advantageous to only actuate transducer segments that correspond to the determined media size so that additional transducer segments do not cause excessive wear on the fuser belt 203. As such, by not actuating the transducer segments 211 at positions unnecessarily, excessive wear of the fuser belt 203, or various components of the stripping mechanism 207 such as transducer segments 211, may be prevented. Additionally, selectively actuating transducer segments 211 may enable optimized stripping performance by selecting multiple selectable strip radii 209 across the width of the fuser belt for different image types, image locations, image preferences, etc.

The one or more strip radii 209 may be selectively changed on demand by adjusting the amplitude at which the one or more transducer segments 211 move or pulse. For example, a greater amplitude of movement may cause a greater deflection of the fuser belt 203 than a lesser amplitude of movement. The relationship of strip radius 209 magnitude with transducer segment 211 movement amplitude is such that a greater deflection of the fuser belt 203 caused by a transducer segment 211 moving at a greater amplitude causes a smaller strip radius 209 than a transducer segment 211 moving at a smaller amplitude.

The stripping mechanism 207 may be activated to cause or change the one or more strip radii 209 on demand for various process conditions, process timings and/or preferences. For example, the stripping mechanism 207 may be caused to actuate one or more transducer segments 211 so as to move at a certain amplitude to cause a small stripping radius 209 at a lead edge (LE) of a substrate as it moves through the fusing nip 205 toward the stripping location 213. Then the stripping mechanism 207 may be caused to change the stripping radius 209 to a larger magnitude by causing the one or more transducer segments 211 to move at a smaller amplitude for the trailing edge (TE) of the substrate. The stripping radius 209 may be changed, for example, after the substrate's LE has been stripped from the fuser belt 203 and/or as the substrate's LE moves past the stripping location 213 in the process direction.

In addition to process timing such as LE, body and TE, actuation and/or amplitude adjustment, may be adjusted by the stripping mechanism 207 to affect stripping of heavyweight media and lightweight media, for example by causing selectable increases and decreases in strip radii magnitude on demand based on a determination of media type, thickness, dimensions, etc. For example, heavyweight media may require a medium strip radius 209 based on a medium-large shoe-to-roll gap, while a lightweight media may require inducing a small strip radius 209 by increasing the amplitude of movement of the one or more transducer segments 211 at the ultrasonic frequency.

In one or more embodiments, the one or more transducer segments 211 may comprise any elastomer material, rubber, polymer and/or metal, and may be coated with a friction reducing coating such as Teflon®. In some embodiments, some or all of the transducer segments 211 may be of the same, or different materials. For example, it may be desirable to have a transducer segment of a certain material at a position that may be used to strip a central region of a substrate as opposed to an outer region of the substrate where it may be desirable to have a transducer segment of a different material.

Some materials, for example, may be more flexible or have a different spring constant than others which could affect the degree of strip radius magnitude and/or consistency during a print process. For example, depending on deformability and belt tension of the fuser belt 203, the flexibility of the transducer segment may have an effect on how much the fuser belt 203 is deflected when the one or more transducer segments 211 are caused to move at a selected amplitude to cause a selected strip radius 209. If, for instance, the transducer segment 211 is made out of a very flexible material, the transducer segment 211 may deform more when caused to move at a high amplitude than a low amplitude. Such flexibility may enable more "give" in the strip radius 209 when the substrate passes through the stripping location 213, for example. The give in the strip radius 209 may facilitate greater flexibility in accommodating different substrate types and/or stiffnesses, for example. The flexibility of the one or more transducer segments 211 may also be selectively adjusted by choosing materials so as to have an effect such as dampening or facilitating any vibrations the fuser belt 203 may experience that are caused by the pulsating transducer segments 211.

In one or more embodiments, the belt-roll fuser 200 may also be configured to determine that different strip radii may be required at an outboard and an inboard position of a substrate compared to a center area of the substrate. To accomplish this, once the media type is determined, any appropriate transducer segments 211 are designated to be actuated, a selectable amplitude may be applied by the stripping mechanism 207 to cause selectable strip radii 209 at positions corresponding to specific outboard and inboard positions of the substrate compared to center area positions of the substrate.

In one or more embodiments, the belt-roll fuser 200 may also be configured to determine a side of the substrate and cause the stripping mechanism 207 to adjust the strip radii 209 at any selected location across the width of the fuser belt 203 and/or process timing such as lead edge or trailing edge to cause optimal stripping performance according to stripping preferences for the determined side of the substrate. For example, if one side of the substrate has an image type or location that requires greater outboard and inboard strip radii compared to another side that has as image type or location requiring lesser outboard and inboard strip radii magnitudes, the stripping mechanism 207 may be caused to adjust the amplitude accordingly to cause optimal strip radii 209 corresponding to selected locations on the substrate to provide optimal stripping performance at the stripping location 213.

In one or more embodiments, the belt-roll fuser 200 may also be configured to determine a type of fuser belt 203, or a thickness of fuser belt 203, and cause the amplitude to be adjusted so as to adjust the one or more strip radii 209 at any selected location across the width of the fuser belt 203 at any process timing such as lead edge or trailing edge to cause optimal stripping performance based on the determined belt type and/or thickness.

In one or more embodiments, the belt-roll fuser 200 may also be configured to determine certain process conditions such as temperature, humidity, print speed, etc. and cause the amplitude to be adjusted so as to adjust the one or more strip radii 209 at any selected location across the width of the fuser belt 203 at any process timing such as lead edge or trailing edge to cause optimal stripping performance. For example, the strip radii 209 may be adjusted at any position to account for the substrate sticking to the fuser belt 203 on account of a heightened humidity.

Figure 4:
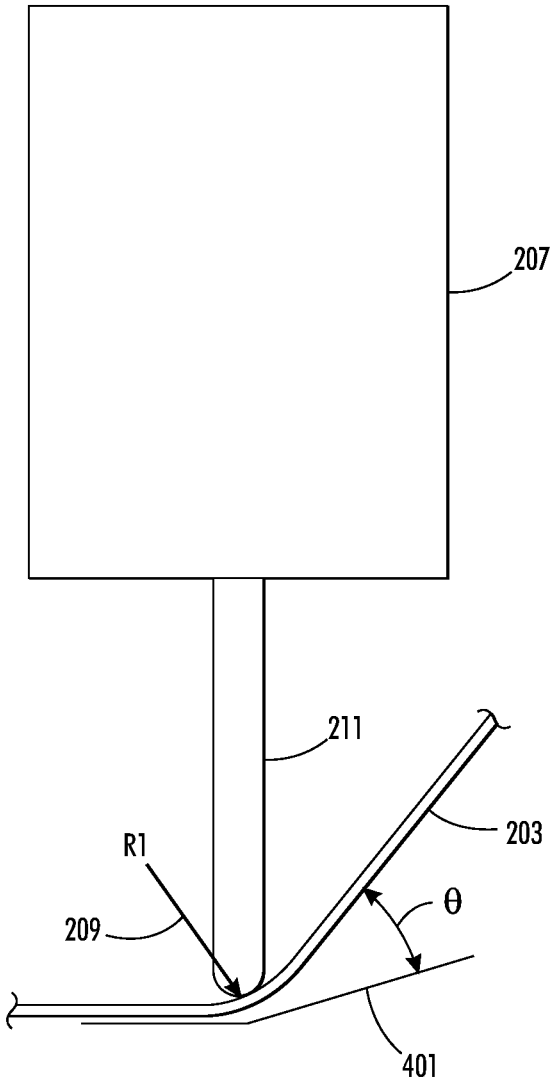
FIG. 4 is a diagrammatical side view of a transducer-type stripping mechanism operating at a low amplitude, according to one example embodiment.

FIG. 4 illustrates the stripping mechanism 207 being actuated to cause a stripping radius 209 R1 , for example. The stripping radius 209 causes, for example, a stripping angle θ which is the angle between the substrate 401 and the fuser belt 203 as the substrate 401 is stripped from the fuser belt 203. Though illustrated in a "down" position against the fuser belt 203, the transducer segment 211, as discussed above, pulses against the fuser belt 203 to cause the stripping radius 209. The transducer segments 211, move both up and down at an ultrasonic frequency at a predetermined "low" amplitude that causes the one or more selectable strip radii 209 to be R1 in magnitude.

The degree of amplitude may be selected by a user, or the belt-roll fuser 200 based, at least in part, on various process conditions or determined media type, image location, etc. The low amplitude causes a smaller deflection of the fuser belt 203, which in turn results in the strip radius R1 which is greater in magnitude than a strip radius R2 (discussed below in FIG. 5). Strip radius R2 discussed below is caused by the stripping mechanism 207 operating under an instruction to move the one or more transducer segments 211 at a high amplitude to cause the smaller strip radius R2.

Figure 5:
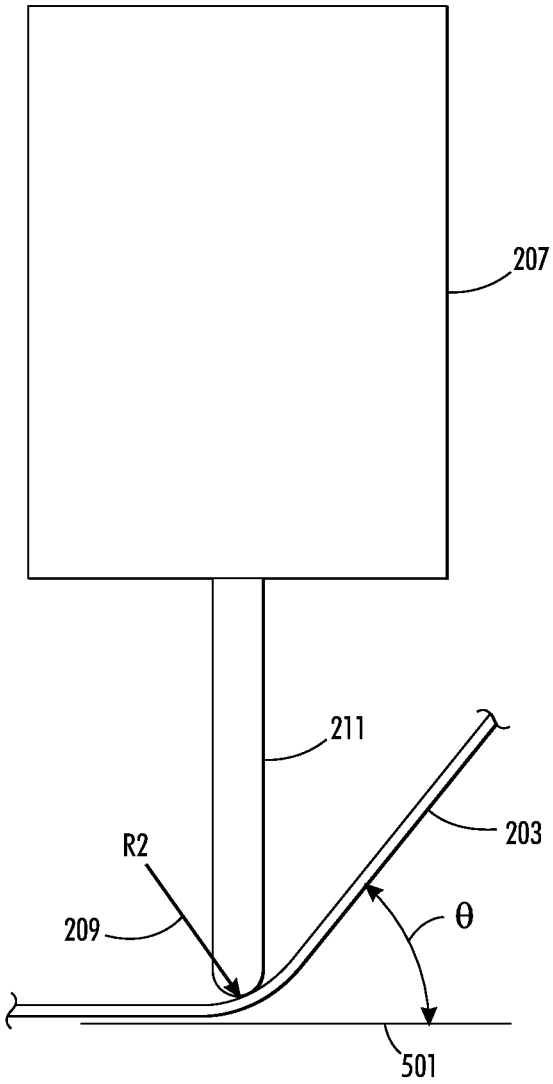
FIG. 5 is a diagrammatical side view of a transducer-type stripping mechanism operating at a high amplitude, according to one example embodiment.

FIG. 5 illustrates the stripping mechanism 207 operating at a "high" amplitude. The degree of amplitude may be selected by a user, or the belt-roll fuser 200 based, at least in part, on various process conditions or determined media type, image location, etc. The high amplitude causes a greater deflection of the fuser belt 203, which in turn results in a strip radius R2 that is smaller in magnitude than the strip radius R1 discussed above. The resulting stripping radius 209 having a magnitude R2 causes a stripping angle θ between the substrate 501 and the fuser belt 203 that is greater in magnitude than the stripping angle θ caused in FIG. 4. Variations in stripping angle are caused by the selectable stripping radii 209 and a relationship between how different substrate properties such as dimension, thickness, type, etc react with particular strip radii magnitudes during a print process. The selectable strip radii 209, accordingly, are adjusted to cause an optimal stripping angle so that the substrate strips from the fuser belt 203 at the stripping location 213, discussed above, while reducing and/or eliminating the IQ defects discussed above.

Figure 6:
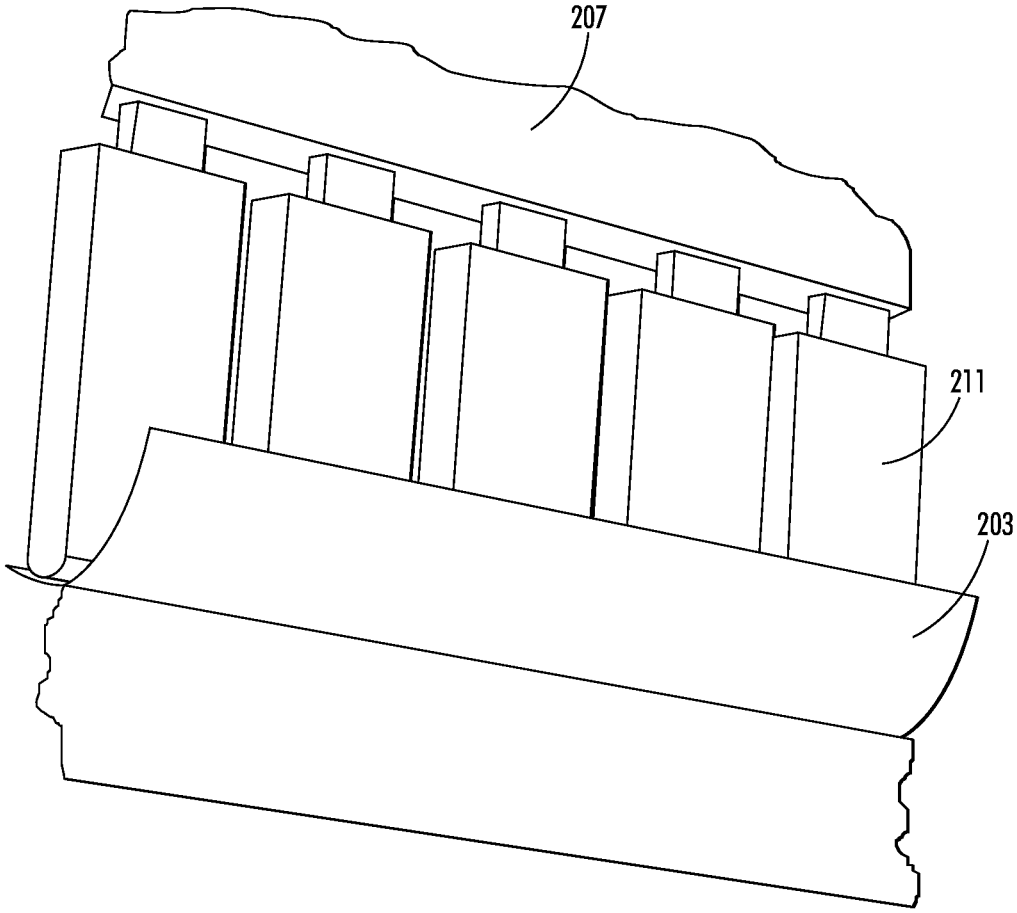
FIG. 6 is a diagrammatical perspective view of a transducer-type stripping mechanism that is selectively actuated across the width of a fuser belt, according to one example embodiment.

FIG. 6 illustrates a perspective view of the stripping mechanism 207 having multiple transducer segments 211, which may be selectively actuated across the width of the fuser belt 203 on demand. For example, transducer segments 211 may be actuated when other transducer segments may be not actuated so that some are caused to deflect the fuser belt 203 to cause one or more selectable strip radii 209 at one or more selected locations across the width of the fuser belt 203 while some are not caused to deflect the fuser belt 203. The selection of which transducer segment(s) 211 are to be actuated, as discussed above, accommodates media sizes that are smaller than an overall width of the fuser belt 203, for example, to avoid excessive wear of the fuser belt and/or components of the stripping mechanism 207. Selected actuation also causes preferred strip radii 209 across the width of a substrate at selected locations to accommodate various inboard/outboard stripping preferences, for example. The strip radii 209 across the width of the fuser belt 203 may, in one or more embodiments, be of the same or different magnitude.

The actuation of any of the transducer segments 211 may be caused to optimize stripping performance for any combination of reasons, such as media size, media type, media thickness, media stiffness, belt size, image type, image location, print side, process speed, process conditions such as temperature and humidity, etc. Accordingly, as discussed above, the individual actuation of any of the transducer segments 211 to cause one or more selectable strip radii 209, discussed above, may occur to individually tailor the stripping performance of a print operation for a lead edge of a substrate, a trailing edge of a substrate, cause differing inboard, outboard and central strip radii, or change strip radii for any specific image preference, to optimize stripping performance in view of the reasons discussed above, as well as to customize various strip radii 209 so that stripping performance may be optimized in view of real-time print job output as viewed by an operator, for example.

Figure 7:
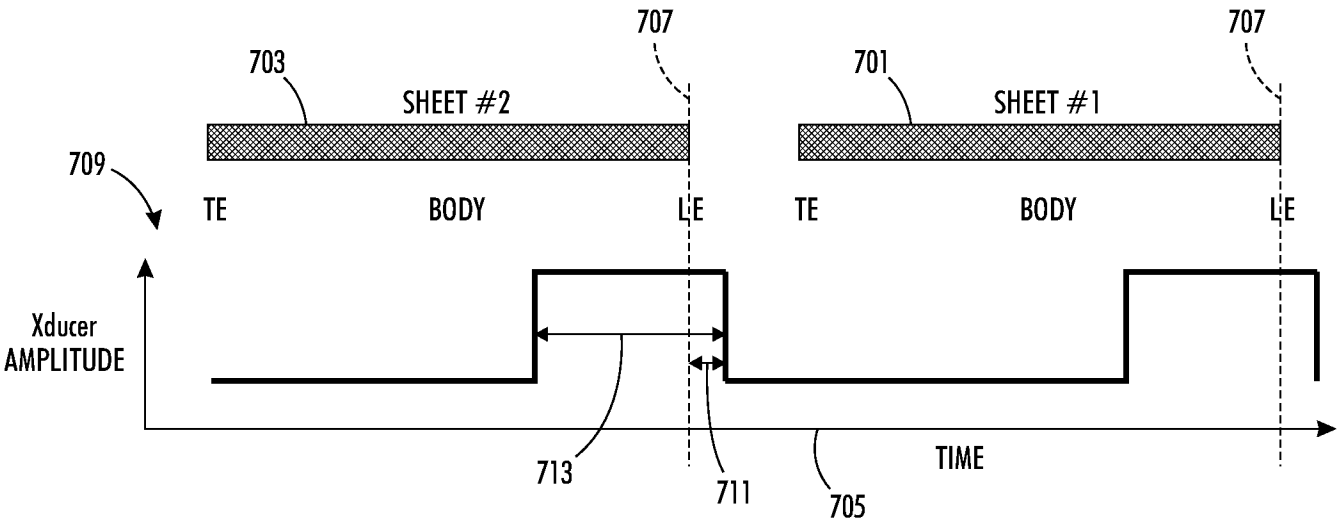
FIG. 7 is a diagram of an actuation pattern of a transducer-type stripping mechanism, according to one example embodiment.

FIG. 7 illustrates an example operation pattern of the stripping mechanism 207. For example, the one or more selectable strip radii 209, discussed above, may be selectable to be changed on demand based, at least in part, on the amplitude of movement of the one or more transducer segments 211 when they are caused to be moved at an ultrasonic frequency by the stripping mechanism 207.

Accordingly, FIG. 7 illustrates a printing process during which the one or more strip radii 209, discussed above, are caused to be varied on demand based on a determined moment in the print process. For example, as sheet #1 701 and sheet #2 703 move through the fusing nip 205 discussed above in a process direction over time 705, each sheet approaches a point in the printing process at which the stripping radius 209 is induced by the stripping mechanism 207 as discussed above, for example a position 707 that may correspond to the stripping location 213 discussed above. The amplitude 709 of movement of the one or more transducer segments 211 is adjusted on demand to induce an optimal striping radius 209 for the particular portion of the sheet #1 701 and/or sheet #2 703 as that portion passes the position 707. The inducement of the selected amplitude that causes the selected strip radius 209 on demand and the switching of that amplitude to another amplitude during the printing process may be referred to as ultrasonic switching.

In this example, the stripping mechanism 207 may cause a large amplitude of movement of the one or more transducer segments 211 as discussed above for the LE of the sheet #1 701 to induce a selected small stripping radius 209, but then the stripping mechanism 207 may cause a lesser magnitude of amplitude of movement of the one or more transducer segments 211 for the body and/or TE of the sheet #1 701, resulting in a larger selected stripping radius 209. Then, when sheet #2 703 arrives at the stripping location 213 discussed above where the sheet is to be stripped from the fuser belt 203, the stripping mechanism 207 may cause the amplitude to be increased on demand for the LE of sheet #2 703 and the amplitude to be decreased as the sheet #2 703 progresses through the belt-roll fuser 200 discussed above in FIG. 3.

As such, not only is the amplitude of movement 709 of the one or more transducer segments 211 a feature that may be adjusted, but also at least one timing 711 that is associated with a change in amplitude may also be adjusted. For example, a process timing 711 corresponding to when the amplitude may be adjusted before the media sheet reaches the position 707 as the sheet moves through the printing process. Additionally, a duration value 713 may be adjusted on demand to control how long the amplitude should remain at the selected magnitude for the selected strip radius 209. The three key parameters (amplitude 709, timing 711, and duration 713) can be established for optimizing LE stripping, for example, and adjusted on demand as necessary for differing stripping performance requirements based on one or more of media types, process timing, media weights, image preferences, image location, etc. for example. Such timing based actuation limits an amount of wear that the fuser belt 203 and/or the stripping mechanism 207 may experience though usage over time by controlling how long the transducer segments 211 are operating at a high amplitude, for example.

Figure 8:
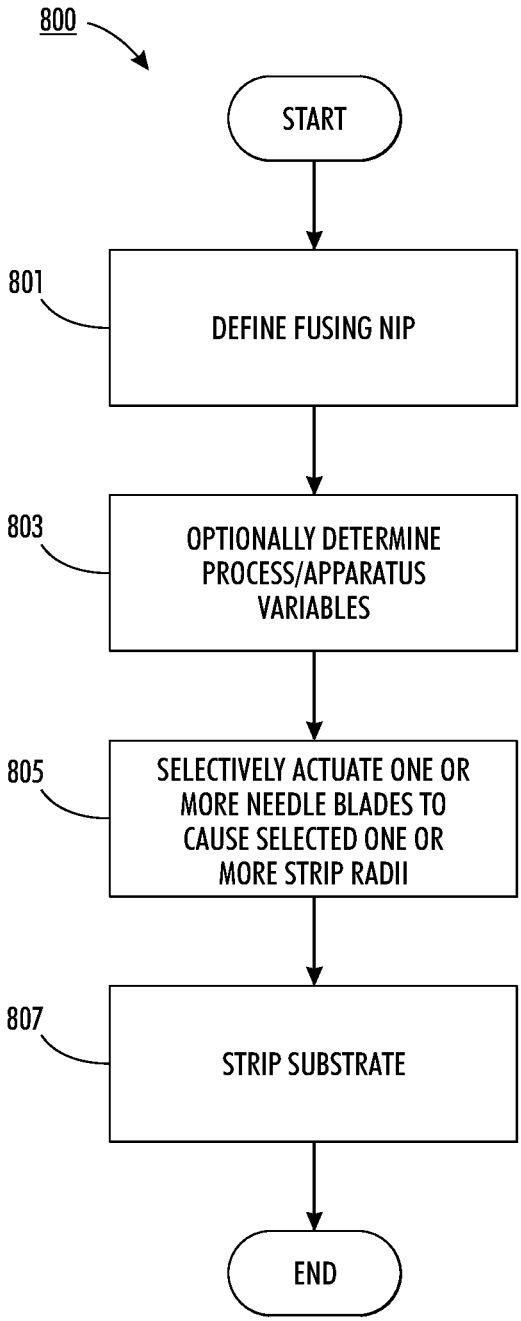
FIG. 8 is a flowchart of a process for stripping a substrate from a fuser belt, according to one example embodiment.
Figure 9:
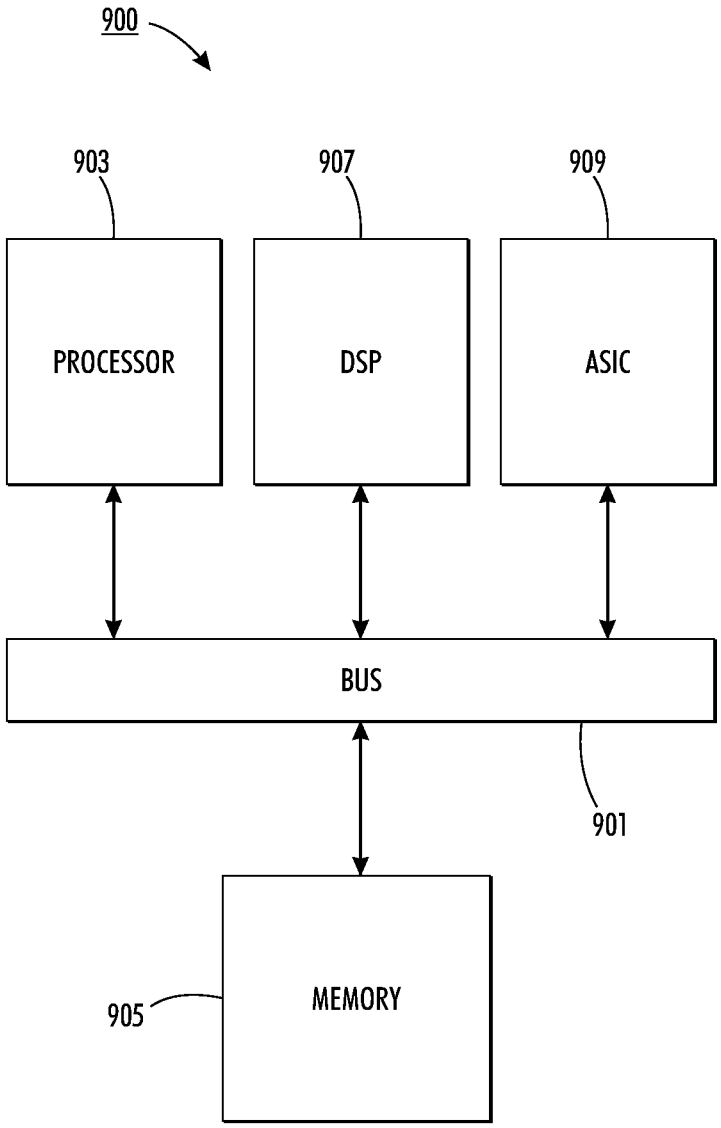
FIG. 9 is a diagram of a chip set that can be used to implement an example embodiment.

FIG. 8 is a flowchart of a process for stripping a substrate from a fuser belt 203, according to one embodiment. In one embodiment, the belt-roll fuser 200 discussed above performs the process 800 by way of a control module implemented in, for instance, a chip set including a processor and a memory as shown in FIG. 9. In step 801, the belt-roll fuser 200 defines a fusing nip 205 in the belt-roll fuser 200. The belt-roll fuser 200 may have, for example, a pressure member such as the EPR 201, another pressure member such as the IPR 202 and a fuser belt 203 arranged such that when the fuser belt 203 is entrained between the EPR 201 and the IPR 202, this region under pressure may be defined as the fusing nip 205.

The process continues to step 803 in which the belt-roll fuser 200 optionally determines various process variables that may be considered for optimizing stripping performance of a substrate from the belt-roll fuser 200. For example, various process variables may include any combination of media size, media type, media thickness, media stiffness, belt size, image type, image location, print side, process speed, process conditions such as temperature and humidity, etc.

Next, in step 805, the belt-roll fuser 200 optionally causes, at least in part, the stripping mechanism 207 to cause one or more transducer segments 211 to deflect the fuser belt 203 at a selectable frequency and/or amplitude to cause one or more selectable strip radii 209 at selected positions on the fuser belt 203.

Accordingly, the one or more selectable strip radii 209, as discussed above, may provide for customizable stripping performance for an inboard position, an outboard position, a lead edge, a trailing edge, a central position, or any selectable position across the width of the fuser belt 203 to optimize stripping performance.

Then, in step 807, the belt-roll fuser 200 strips the substrate from the fuser belt 203 at the stripping location 213, discussed above.

FIG. 9 illustrates a chip set or chip 900 upon which an embodiment of the invention may be implemented. Chip set 900 is programmed to control the one or more ultrasonic stripping mechanisms to cause one or more selectable strip radii on demand as described herein and includes, for instance, a processor and memory components incorporated as one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 900 can be implemented in a single chip. It is further contemplated that in certain embodiments the chip set or chip 900 can be implemented as a single "system on a chip." It is further contemplated that in certain embodiments a separate ASIC would not be used, for example, and that all relevant functions as disclosed herein would be performed by a processor or processors. Chip set or chip 900, or a portion thereof, constitutes an example means for performing one or more steps of causing one or more selectable strip radii on demand.

In one embodiment, the chip set or chip 900 includes a communication mechanism such as a bus 901 for passing information among the components of the chip set 900. A processor 903 has connectivity to the bus 901 to execute instructions and process information stored in, for example, a memory 905. The processor 903 may include one or more processing cores with each core configured to perform independently. A multi-core processor enables multiprocessing within a single physical package. Examples of a multi-core processor include two, four, eight, or greater numbers of processing cores. Alternatively or in addition, the processor 903 may include one or more microprocessors configured in tandem via the bus 901 to enable independent execution of instructions, pipelining, and multithreading. The processor 903 may also be accompanied with one or more specialized components to perform certain processing functions and tasks such as one or more digital signal processors (DSP) 907, or one or more application-specific integrated circuits (ASIC) 909. A DSP 907 typically is configured to process real-world signals (e.g., sound) in real time independently of the processor 903. Similarly, an ASIC 909 can be configured to perform specialized functions not easily performed by a more general purpose processor. Other specialized components to aid in performing the functions described herein may include one or more field programmable gate arrays (FPGA), one or more controllers, or one or more other special-purpose computer chips.

In one embodiment, the chip set or chip 900 includes merely one or more processors and some software and/or firmware supporting and/or relating to and/or for the one or more processors.

The processor 903 and accompanying components have connectivity to the memory 905 via the bus 901. The memory 905 includes both dynamic memory (e.g., RAM, magnetic disk, writable optical disk, etc.) and static memory (e.g., ROM, CD-ROM, etc.) for storing executable instructions that when executed perform the steps described herein to control the one or more selectable strip radii. The memory 905 also stores any data associated with or generated by the execution of the steps discussed herein.

While the above apparatuses, methods and systems for causing one or more selectable strip radii on demand are described in relationship to exemplary embodiments, many alternatives, modifications, and variations would be apparent to those skilled in the art. Accordingly, embodiments of apparatuses, methods and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. An apparatus useful in printing comprising:

a first member having a first surface;

a belt having a first portion that contacts the first surface of the first member;

a second member having a second surface that contacts a second portion of the belt in a region defining a fusing nip; and a stripping apparatus, positioned downstream of the fusing nip in a process direction, comprising one or more transducers configured to cause one or more respective transducer segments to move at a frequency so as to deflect one or more selected sections of the first portion of the belt to cause one or more selectable strip radii relative to the belt on demand at a stripping location associated with stripping a substrate from the belt downstream of the fusing nip in the process.

2. The apparatus of claim 1, wherein the one or more selectable strip radii are controlled, at least in part, by selectively actuating one or more of the one or more transducers.

3. The apparatus of claim 1, wherein one or more magnitudes of the one or more selectable strip radii are further controlled based, at least in part, on a respective amplitude of movement of the one or more respective transducer segments caused by the one or more transducers.

4. The apparatus of claim 1, wherein the one or more selectable strip radii are selectively caused to change based on a determination of a media type.

5. The apparatus of claim 1, wherein the one or more selectable strip radii are selectively caused to change based on a determination of a media geometry.

6. The apparatus of claim 1, wherein the one or more selectable strip radii are selectively caused to change based on a determination of a belt geometry.

7. The apparatus of claim 1, wherein the one or more selectable strip radii are selectively caused to change based on a determination of an image type.

8. The apparatus of claim 1, wherein the one or more selectable strip radii are selectively caused to change based on a determination of an image location on a media.

9. The apparatus of claim 1, wherein the one or more selectable strip radii are selectively caused to change based on a determination of a process speed.

10. The apparatus of claim 1, wherein the one or more selectable strip radii are selectively caused to change based on a determination of a process timing.

11. The apparatus of claim 1, wherein the one or more transducers may cause the belt to vibrate at a frequency that corresponds with the frequency at which the one or more respective transducer segments move to aid in stripping the substrate from the belt.

12. The apparatus of claim 1, wherein the one or more transducers are ultrasonic transducers and cause the one or more respective transducer segments to move at an ultrasonic frequency.

13. A method for stripping a substrate in a printing process comprising:

defining a fusing nip in an apparatus useful in printing, the apparatus comprising:

a first member having a first surface;

a belt having a first portion that contacts the first surface of the first member;

a second member having a second surface that contacts a second portion of the belt in the fusing nip; and a stripping apparatus, positioned downstream of the fusing nip in a process direction, comprising one or more transducers configured to cause one or more respective transducer segments to move at a frequency so as to deflect one or more selected sections of the first portion of the belt to cause one or more selectable strip radii relative to the belt on demand at a stripping location associated with stripping the substrate from the belt downstream of the fusing nip in the process direction;

causing, at least in part, the one or more selectable strip radii on demand; and causing, at least in part, stripping of the substrate from the belt at the stripping location.

14. The method of claim 13, further comprising:

causing, at least in part, the one or more selectable strip radii to be controlled by selectively actuating one or more of the one or more transducers.

15. The method of claim 14, further comprising:

causing, at least in part, one or more magnitudes of the one or more selectable strip radii to be further controlled based, at least in part, on a respective amplitude of movement of the one or more respective transducer segments caused by the one or more transducers.

16. The method of claim 13, wherein the one or more selectable strip radii are selectively caused to change based on a determination of a media type.

17. The method of claim 13, wherein the one or more selectable strip radii are selectively caused to change based on a determination of a media geometry.

18. The method of claim 13, wherein the one or more selectable strip radii are selectively caused to change based on a determination of a belt geometry.

19. The method of claim 13, wherein the one or more selectable strip radii are selectively caused to change based on a determination of an image type.

20. The method of claim 13, wherein the one or more selectable strip radii are selectively caused to change based on a determination of an image location.

21. The method of claim 13, wherein the one or more selectable strip radii are selectively caused to change based on a determination of a process speed.

22. The method of claim 13, wherein the one or more selectable strip radii are selectively caused to change based on a determination of a process timing.

23. The apparatus of claim 13, wherein the one or more transducers may cause the belt to vibrate at a frequency that corresponds with the frequency at which the one or more respective transducer segments move to aid in stripping the substrate from the belt.

24. The apparatus of claim 13, wherein the one or more transducers are ultrasonic transducers and cause the one or more respective transducer segments to move at an ultrasonic frequency.

25. A system useful in printing configured to strip a substrate from a belt at a position downstream of a fusing nip in a process direction, the system comprising:

a first member having a first surface;

a belt having a first portion that contacts the first surface of the first member;

a second member having a second surface that contacts a second portion of the belt in the fusing nip; and a stripping apparatus, positioned downstream of the fusing nip in the process direction, comprising one or more transducers configured to cause one or more respective transducer segments to move at a frequency so as to deflect one or more selected sections of the first portion of the belt to cause one or more selectable strip radii relative to the belt on demand at a stripping location associated with stripping the substrate from the belt downstream of the fusing nip in the process direction, wherein the substrate is stripped from the belt at the stripping location.

* * * * *